United States Patent [19]

Carson

[11] 4,355,525

[45] Oct. 26, 1982

[54] PRODUCTION TUBE BENDING MACHINE

[76] Inventor: James W. Carson, Rte. 1 Box 62, Fayetteville, Ark. 72701

[21] Appl. No.: 72,455

[22] Filed: Sep. 4, 1979

[51] Int. Cl.[3] ..... B21D 7/04; B21D 9/05

[52] U.S. Cl. ..... 72/149

[58] Field of Search ..... 72/149, 150, 151, 155, 72/156, 157, 158, 159, 305, 310, 311, 318, 320, 321

[56] References Cited

U.S. PATENT DOCUMENTS

| | | | |
|---|---|---|---|
| 2,312,122 | 2/1943 | Parker et al. | 72/149 |
| 3,017,917 | 1/1962 | Streit | 72/310 |
| 3,205,690 | 9/1965 | Roessler | 72/159 X |
| 3,261,193 | 7/1966 | Van Harten | 72/150 |
| 3,276,235 | 10/1966 | Stanley | 72/149 |
| 3,531,963 | 10/1970 | Garner et al. | 72/310 X |
| 3,545,247 | 12/1970 | Fazzani | 72/310 |
| 4,038,853 | 8/1977 | Schwarze | 72/157 |
| 4,236,398 | 12/1980 | Schwarze | 72/157 |

FOREIGN PATENT DOCUMENTS

| | | | |
|---|---|---|---|
| 1527333 | 6/1973 | Fed. Rep. of Germany | 72/156 |
| 376351 | 5/1964 | Switzerland | 72/158 |
| 880691 | 10/1961 | United Kingdom | 72/158 |

*Primary Examiner*—Ervin M. Combs
*Attorney, Agent, or Firm*—Robert R. Keegan

[57] ABSTRACT

There is disclosed a tube bending machine with a rotatable die having a tubing clamp associated therewith and a stationary wiper block to bend a tubing work piece around the die as it rotates. The wiper block and tubing clamp are placed into and locked in operative position with similar toggle linkages which are adjustable to accommodate different bending dies and wiper blocks. The die is rotated by a fluid pressure linear actuator chain driving a sprocket secured to a common shaft with the die; the chain is pinned at one end to the sprocket and the sprocket has a torsion spring connected thereto applying tension to the chain and causing the die to return when the actuator moves to slacken the chain. An adjustable stop limits the travel of the actuator shaft and a pointer which moves with the stop reads against a scale to directly indicate degree of bend. The actuator is operated on the bend stroke by a pilot valve operated by the wiper block toggle mechanism; the pilot valve operates the main valve controlling the linear actuator. Another pilot valve is hand lever operated and causes extension of the linear actuator by the main valve so that the spring returns the rotatable die; before this takes place this pilot valve pressurizes a work piece ejection actuator positioned to strike the work piece to dislodge it if it is stuck in the die. A mandrel carriage slides on a rail under control of a toggle mechanism to insert or retract a mandrel; the carriage is adjustable both laterally and longitudinally of the mandrel axis and the mandrel is vertically adjustable on the carriage. There is an arrangement for rapid replacement of bend dies including a boss and a stud on the die table mating with depressions in the die and a draw bolt mating with a tapped hole in the bottom of a die and rotatable by a hand wheel connected to the end of the bolt shaft which extends vertically through the sprocket drive shaft and drive table.

10 Claims, 16 Drawing Figures

PRODUCTION TUBE BENDING MACHINE

This invention relates to machines for bending metal tubing to form elbows and other bent tubing components which are utilized in the manufacture of refrigeration equipment or other equipment requiring somewhat complicated tubing configurations for fluid handling functions. The bending machine according to the invention performs a rotary draw bending process which is well known and in widespread use.

The typical use of the machine would be to produce lots of hundreds or thousands of identical bent tubing components to stock for production of particular refrigeration units or the like. It is important that the bent tubing components be produced rapidly because of the need for substantial numbers of the parts, but it is also important that the change in setup to produce a different part can be made relatively quickly and without requiring great skill. Improvements in the apparatus according to the invention contribute to the speed of production and the facility for changing dies and otherwise modifying the setup for a different part.

Another important consideration is safety of the operator. The apparatus of the present invention achieves the advantages of speedy operation and change of setup while providing features for the prevention of accidents and safety of the operator.

Tube bending machines employing a rotary draw bending process conventionally operate as follows. A bend die is provided which is dimensioned to accord with the tubing outside diameter and the radius of the bend. A clamp secures a piece of precut tube in the bend die; in some cases two tubes will be bent in one operation using a double bend die.

Generally there are mandrels which are advanced into the tube and function to prevent collapse of the tube while the bend is being made. These mandrels are therefore selected to correspond to the internal diameter of the tubing.

A wiper block is advanced against the tube after which the bend die and bend die clamp are rotated through a predetermined angle while the wiper block and the mandrel remain stationary. As the tube is drawn along the wiper block it wraps against the bend die so that the radius of the bend conforms (approximately) to the bend die radius. At the same time the tube interior is drawn over the mandrel with the mandrel maintaining the cross-sectional shape of the tube as the bend is being made. Often the rotation of the bend die and bend die clamp is powered by an air cylinder or hydraulic cylinder.

Once the bend has been made in the tubing it is released by the operator and the apparatus is returned to the starting position to accept another precut tube and the operation is repeated.

Apparatus performing the operations described above is conventional and does not form a part of the present invention. The apparatus of the invention incorporates improvements to such apparatus which provide advantages not previously available. The apparatus according to the invention is described as a relatively small production machine wherein the feeding and clamping operations are accomplished by hand and only the bending process (and the ejection of the finished part) is an automatic, pneumatic-powered process.

The apparatus of the present invention has in particular a novel system for setting the proper degree of bend.

It is important to control the degree of bend in the parts accurately and reliably. The degree of bend can vary from a few degrees to 180 degrees. In the apparatus of the invention the bend die table is mechanically coupled to a sprocket and a sprocket chain secured to and extending over 180 degrees around the sprocket is secured to a linear power actuator such as a pneumatic cylinder.

This mechanism is capable of powering the bend die table in the working direction (clockwide in the specific example), and cannot power the table in the return direction. This is an advantage in providing a safety feature whereby the table is returned by a torsion spring with only moderate force and velocity thus avoiding incapacitating injury to the operator's hand which might occur if the full power of the cylinder were utilized to return the die table and bend die clamp.

The cylinder mechanism which converts the linear motion of the cylinder piston and shaft to rotary motion through the sprocket and chain also has the advantage that the linear travel of the actuator shaft is directly proportional to the rotation of the bend die. This characteristic is exploited by a degree-of-bend stop system operated by providing an adjustable stop for the actuator shaft travel. The position of the stop is set by a screw mechanism which at the same time produces corresponding travel of a pointer on a scale calibrated in degrees and directly indicating the degree of bend for which the apparatus is set. The degree of bend stop system is unaffected by change of the bend die for different tube diameters or bend radii.

Bend dies may be very quickly changed in the apparatus due to the construction of the bend die table. The bend die table has a centering boss and a driving stud so that the bend die is positioned on the bend die table and will rotate with it. A die mount hand wheel has a shaft which extends upwardly through the table and threadedly engages the bend die and clamps it securely to the top surface of the bend die table. Thus changing the bend die is accomplished by simply rotating the hand wheel to release the previous die, lifting off the previous die, replacing it with a new die, and turning the hand wheel to draw the new die tight on the upper surface of the bend die table.

Changing and adjusting of the mandrels in the apparatus of the present invention is also quite simple and virtually foolproof. If one tube is to be bent in each operation only one mandrel will be used. For bending two tubes at a time two mandrels would be required, of course. The single or double mandrel is customarily mounted in a block. The block is provided with a vertical extending slot and hence the vertical position of the mandrels (which extend horizontally) may be readily adjusted by raising or lowering the position of the block as it is attached to the mandrel carriage by a bolt. The mandrel carriage runs on a slide so that motion of the carriage carries the mandrels into the end of the tube or tubes to be bent. The carriage is operated by a hand toggle mechanism. The fixed end of the toggle is secured on the rail with a hand clamp so that the degree of extension of the mandrels into the tube may be adjusted by properly locating and clamping the fixed end of the toggle mechanism on the mandrel rail. The mandrel rail is mounted on two cross rails and is provided with a threaded rod feed mechanism to control the transverse position of the mandrels to accommodate differences in tube bend radius, it being understood that the mandrels must be positioned so that the extension of their axis is offset from the vertical axis of rotation of the bend die table by an amount equal to the radius of curvature of the bend. A clamp is provided to fix the transverse or lateral position of the mandrel adjustment.

The speed of operation of the apparatus is enhanced by the provision for bending cylinder actuation upon completion of the setting of the wiper block toggle which is the last step in placing and clamping the tube in the apparatus. Also the last step of returning the die table causes the ejection of the finished work piece by actuation of a small air cylinder operated plunger. This eliminates the necessity for hand removal of the piece which may tend to get stuck in the bending die, especially on high degree bends. The leverage and travel of the mandrel toggle may be changed by moving a link pin to a different hole position.

The above-described features and improvements in the present apparatus provide advantages in efficiency and safety not present in prior tube bending apparatus. Prior apparatus has in some instances employed sprocket and chain mechanisms to convert the force and motion of a linear accelerator to the rotary motion required for the draw bending operation. However, such previous devices as represented by U.S. Pat. No. 3,205,690 and No. 2,312,222, or French Patent No. 1,239,404, do not fully exploit the possibility of such an arrangement in providing a simple, reliable and safe calibrated bend stroke with low force spring return. Neither are the quick setup change and adjustment features of the present invention provided by the prior art devices so far as known.

In addition to providing the above-described features and advantages it is an object of the present invention to provide tube bending apparatus with a bend stop of particularly simple and reliable construction wherein the stop for degree of bend control is located on the shaft of the linear actuator, is provided with a screw thread adjustment and a direct linear readout of degree of bend on a readily visible scale.

It is another object of the present invention to provide tubing bending apparatus wherein the bending die clamp is powered on the work stroke by a pneumatic or hydraulic cylinder and is returned by a torsion spring causing the rotation of the bend die table, bend die and clamp to their initial position.

It is a further object of the present invention to provide a tube bending apparatus wherein the tube bending dies and clamps may be readily replaced for different operations and corresponding adjustments of the apparatus for different bend radii and the like is quite simple and requires relatively little skill.

It is still another object of the present invention to provide tube bending apparatus wherein the finished work piece is automatically ejected at the conclusion of the operation notwithstanding the fact that it may stick in the bend die.

Other objects and advantages of the present invention will be apparent from consideration of the following description in conjunction with the appended drawings in which.

Figure 1:
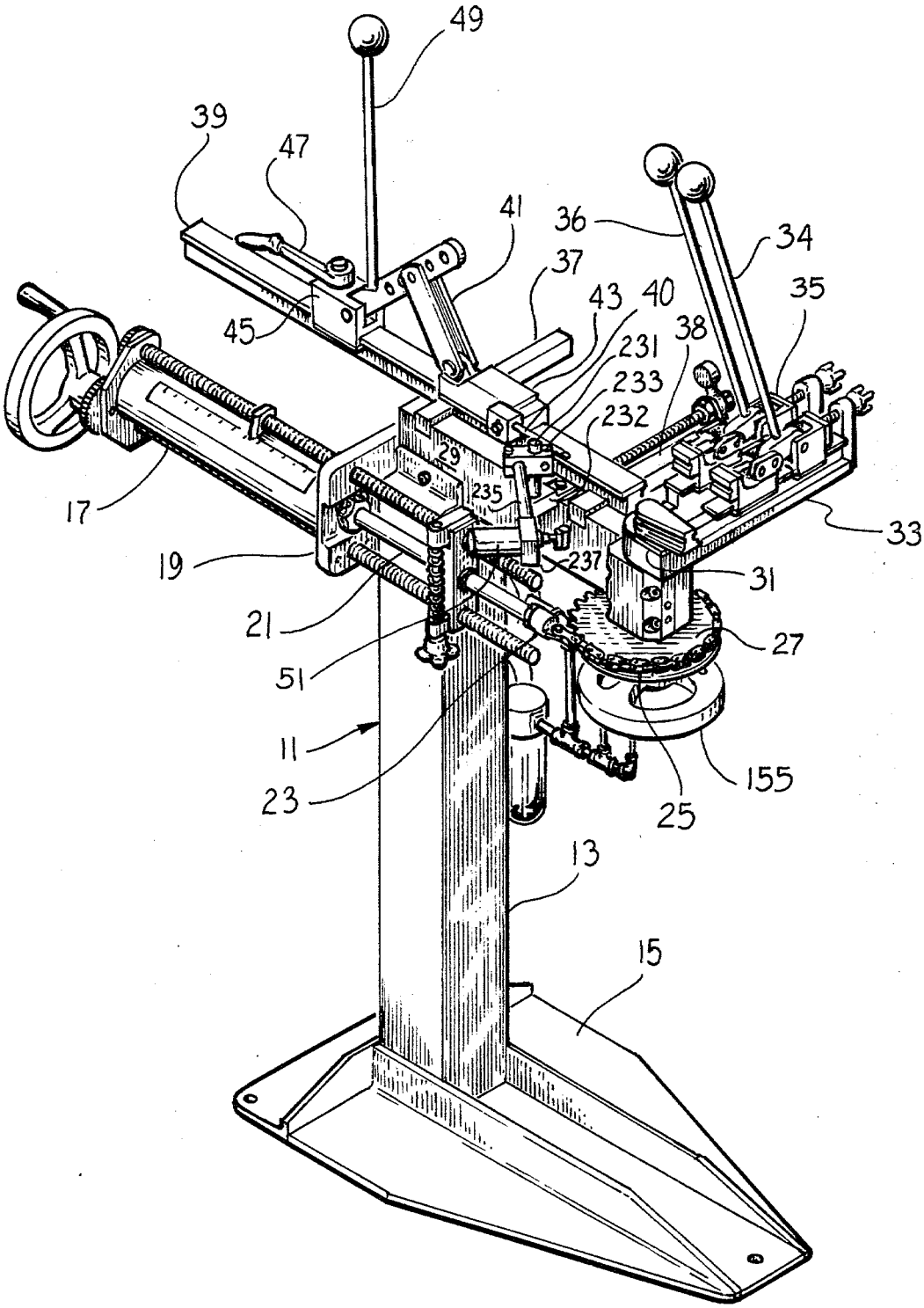
FIG. 1 is a front perspective view of the apparatus according to the present invention.
Figure 2:
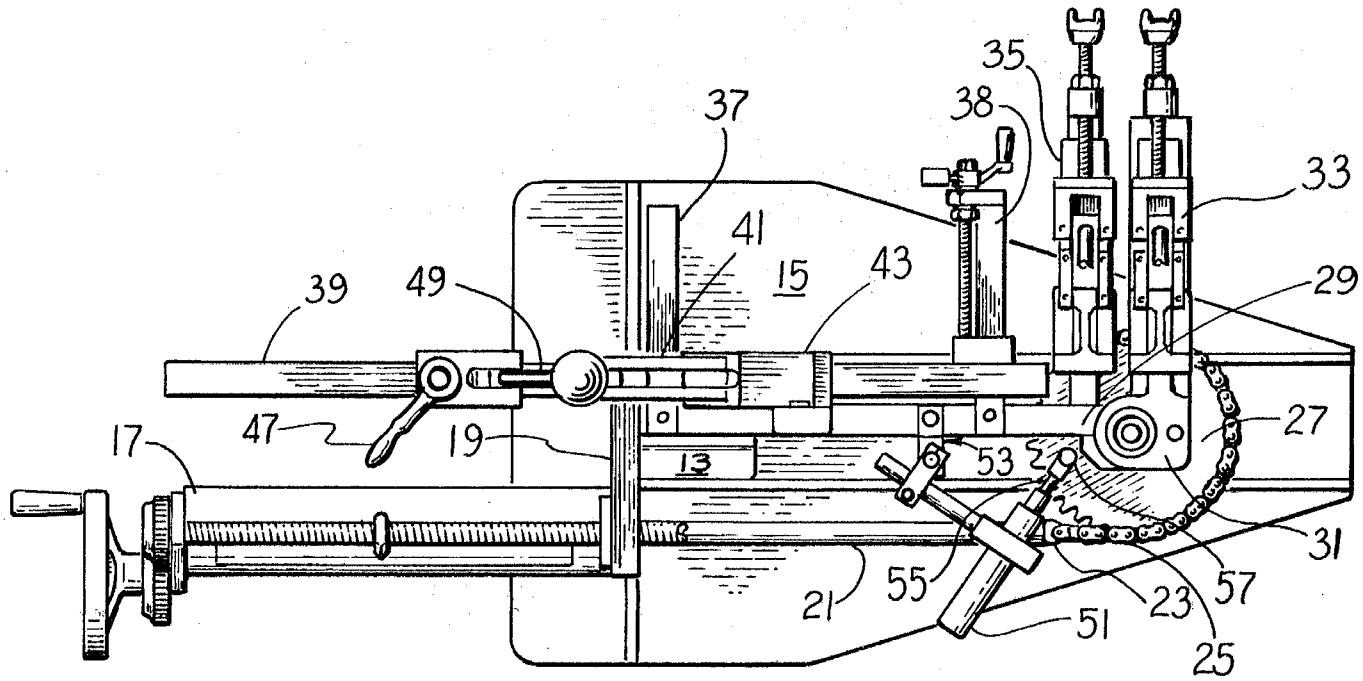
FIG. 2 is a partially fragmentary top plan view of the apparatus of FIG. 1.
Figure 3:
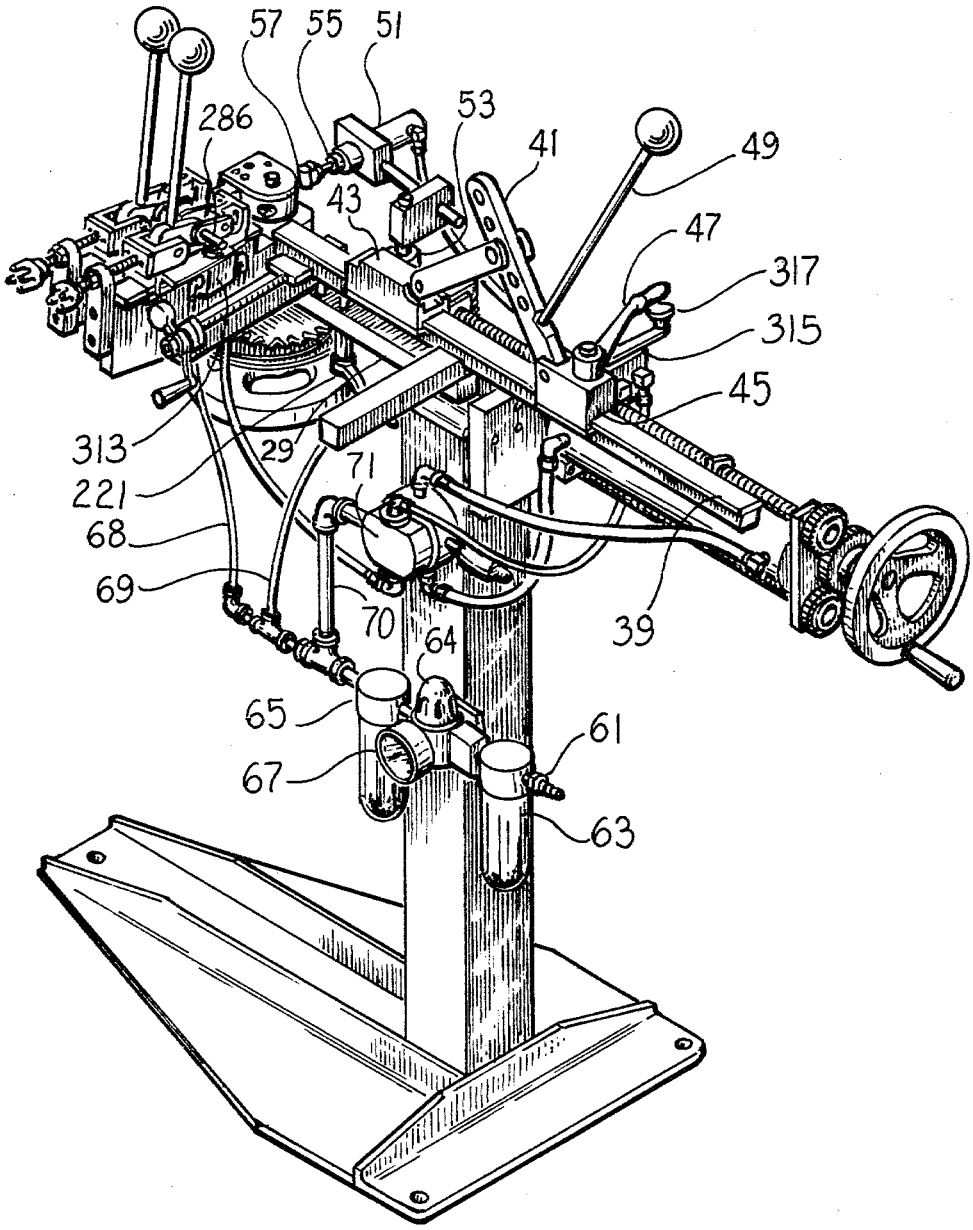
FIG. 3 is a rear perspective view of the apparatus of FIG. 1.

Referring now to the drawings and particularly to FIGS. 1, 2, and 3, tube bending apparatus 11 includes a pedestal 13 with a base 15. Base 15 would normally be bolted or otherwise secured to the floor of the manufacturing plant production area. A pneumatic cylinder 17 is secured to pedestal 13 by a mounting plate 19. Pneumatic cylinder 17 has a shaft 21 with an end fixture 23 to which is pinned a sprocket chain 25. Sprocket chain 25 encircles somewhat more than half of sprocket 27 and is pinned thereto at its end (not shown in FIGS. 1–3).

Sprocket 27 is rotatably mounted on the bottom of arm 29 which extends from pedestal 13. A die mount table 31 is secured to a common shaft (not shown in FIGS. 1–3) with sprocket 27. Tube clamp arm 33 extends from die mount table 31 and rotates with it in the bending operation. Wiper block clamp arm 35 is fixedly secured to arm 29 and with the wiper block (not shown in FIGS. 2–3) restrains the free end of the tube against the bending force exerted by the bending die and the tube clamp arm 33.

A pair of mandrel extractor cross rails 37 and 38 are mounted to and extend from arm 29. A mandrel extractor rail 39 slidably engages cross rails 37 and 38 so that it is parallel to arm 29 but adjustable in lateral position toward and away from the center of die mount table 31. A mandrel extractor toggle 41 is connected at one end to a mandrel carriage 43 slidably mounted on rail 39. The back end of toggle 41 is secured to rail 39 by a clamp 45 operated by a clamp handle 47. A handle 49 on mandrel extractor toggle 41 is used by the operator to slide mandrel carriage 43 along rail 39 to insert and extract the mandrels from the tubes being bent.

A small pneumatic cylinder 51 is mounted by means of an adjustable mounting bracket 53 so that its shaft 55 is directed toward the die mount table where the work piece is positioned at the end of the bending operation. A bumper 57 of rubber or other resilient material is preferably provided on the end of shaft 55 so that upon actuation of cylinder 51 shaft 55 is forcibly extended causing bumper 57 to strike the work piece (not shown) and knock it out of the bend die. The tubing knocked out of the die by the action of cylinder 51 may be caught in a container placed next to the apparatus to collect the finished tubing components.

The pneumatic system for the apparatus will be explained in detail with reference to the schematic diagram of FIG. 14, but it may be noted in FIG. 3 that an inlet connection 61 is provided to receive air under pressure from a conventional compressor or other source. An air filter 63 is provided together with a regulator 64, an oiler 65 and a pressure-gauge 67. Air conduits 68, 69, and 70 feed to pilot valves 313 and 315 and the main control valve 71 which is a pressure operated valve operated by the pilot valves. The general operation of the apparatus will be understood by reference to FIGS. 1, 2, and 3, together with the above-description, but a number of the features and advantages of the apparatus relate to the manner in which a setup is made for a particular production operation and particularly the ease of changing dies and making adjustments for a new setup. For an understanding of these features and advantages reference will be made to the enlarged and more detailed figures of the drawings.

One important adjustment to the machine required for a new setup is the setting of the angle of bend for a particular tube bend. The angle of bend will be provided to the machine operator as a part of the specification for the particular part to be produced. The angle of bend will include an allowance for springback determined by the engineer or designer but this is not a matter of concern to the operator.

Figure 4A:
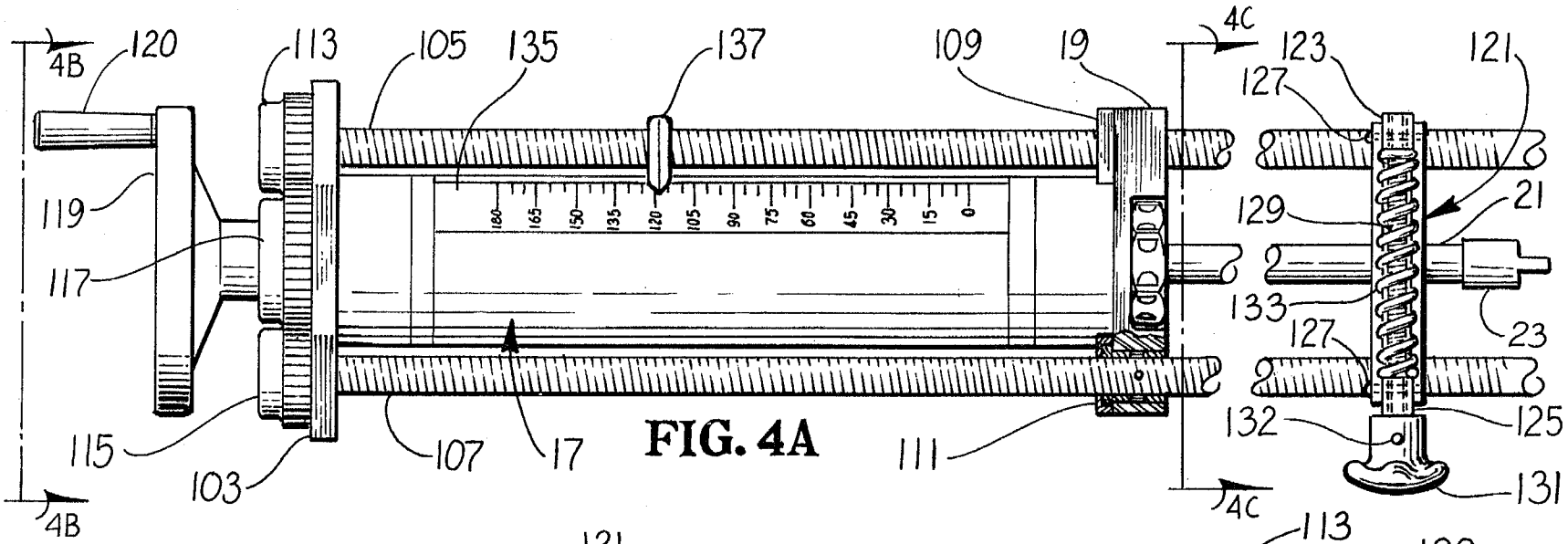
FIG. 4A is an enlarged fragmentary front elevational view of the apparatus of FIG. 1.
Figure 4B:
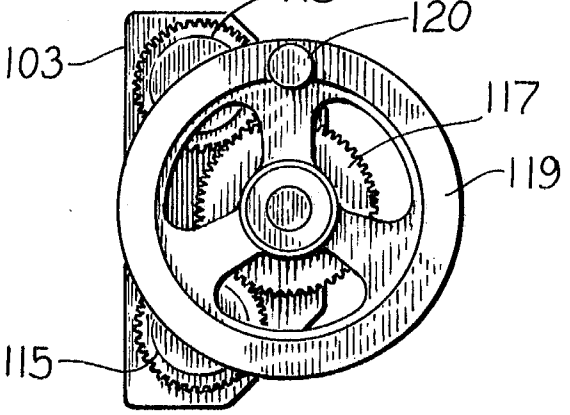
FIG. 4B is a fragmentary view taken along the line 4B—4B in FIG. 4A.
Figure 4C:
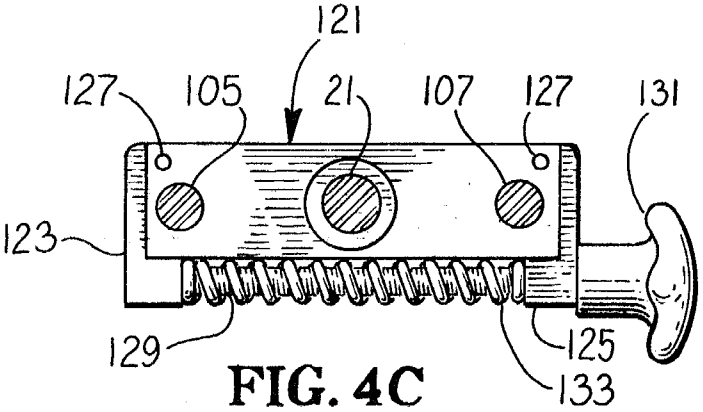
FIG. 4C is a fragmentary partially sectional view taken along the line 4C—4C in FIG. 4A.

The manner in which the apparatus is adjusted by the operator for angle bend can best be appreciated by reference to FIGS. 4A, 4B, and 4C, in addition to the preceding figures. In contrast to other tube bending apparatus the present apparatus provides for control of the degree of bend by a stop operating on the pneumatic cylinder actuator shaft. The penumatic cylinder 17 is shown in an enlarged view in FIG. 4A and as seen therein the cylinder is secured by a large nut 101 to the mounting plate 19. The other end of the cylinder 17 has secured thereto by bolts or other suitable means (not shown) a plate 103. Plate 103 and mounting plate 19 are each provided with through holes for the passage of rods 105 and 107.

Rods 105 and 107 are normally rotatable and are secured in place by collars 109 and 111 as shown in FIG. 4A. Flanged bushings 108 are threaded internally to mate with rods 105 and 107 and secured thereto by pins or other suitable fasteners. Collars 109 and 111 are counterbored to receive the flanges of bushings 108 and hence receive the thrust force from locking unit 121 as it stops end fixture 23. Secured to the ends of rods 105 and 107 are respective gears 113 and 115. Another gear 117 is mounted on a pin in plate 103 for rotation and engagement with gears 113 and 115. Gear 117 has connected thereto a hand wheel 119 with a handle 120. Thus when the operator rotates hand wheel 119 by handle 120 gear 117 drives gears 113 and 115 and also causes rods 105 and 107 to rotate together. At the opposite end of rods 105 and 107 from gears 113 and 115 is a locking unit 121 including at the top and bottom a pair of clamping levers 123 and 125. The cylinder shaft 21 passes through a clearance hole in locking unit 121 and tapped openings are provided in the locking unit to accommodate threaded rods 105 and 107. Threaded rods 105 and 107 pass through a portion of clamping levers 123 and 125 which are mounted for limited pivotal motion to unit 121 by pins 127 or other suitable means. A threaded rod 129 passes vertically through openings in clamping lever 125 and clamping lever 123 and has secured at its bottom end a locking knob 131 with a set screw 132 for securing it on rod 129. The hole through clamping lever 123 is tapped to conform to the threads of rod 129 while the hole through clamping lever 125 is an untapped clearance hole. A compression spring is provided between clamping levers 123 and 125 and rod 129 passes through spring 133.

When knob 131 is loosened spring 133 urges clamping levers 123 and 125 apart so that they do not contact threaded rods 105 and 107. In this situation when hand wheel 119 is rotated to cause rods 105 and 107 to rotate the locking unit 121 travels laterally along rods 105 and 107. The through hole in locking unit 121 is smaller than the diameter of end fixture 23 on shaft 21 and thus acts as a stop to prevent retraction of shaft 21 beyond the point where end fixture 23 strikes the face of locking unit 121.

An internally threaded pointer block 137 is threaded on rod 105 and slides along cylinder 17 without rotation so that the motion of pointer block 137 is determined by the rotation of rod 105 in the same manner that the motion of locking unit 121 is determined. A scale 135 calibrated in degrees is secured to cylinder 17 so that it is readable by the operator. The calibration of scale 135 is determined by the pitch radius of sprocket 27 (180 degrees on the scale is equal to the pitch radius of the sprocket times 3.1416).

To adjust the degree of bend the operator need only loosen knob 131 and turn hand wheel 119 to place pointer block 137 at the desired degree of bend on scale 135; then set locking unit 121 by rotating knob 131 to cause clamping levers 123 and 125 to close on rods 105 and 107 preventing their rotation and preventing displacement of locking unit 121. Locking of the degree of bend mechanism is desirable to avoid possible displacement of the locking unit under repeated impacts of the end fixture 23. It should be noted however that the arrangement of the apparatus is such that relatively little of the mass and inertia of the apparatus creates an impact on locking unit 121. Except for the shaft 21, end fixture 23, and the cylinder piston the remainder of the power operated apparatus is prevented from contributing to impact on locking unit 121 by the chain connection between end fixture 23 and sprocket 27 which can of course communicate force in only one direction. Accordingly the substantial mass and inertia of sprocket 27, the bending die, die mount table 31, and tube clamp arm 33 do not impact on locking unit 121. It has been found that it is unnecessary to stop the motion of these latter elements since they are effectively stopped by the bending resistance of the tube when the force of the cylinder shaft 21 is no longer operative due to the stop action of the locking unit 121 on end fixture 23. The apparatus of the invention is accordingly much simpler since it does not involve a stop mechanism on the sprocket itself nor is there any necessity for the chain to run off the sprocket to a separate stop mechanism since the stop mechanism is in effect built into the power actuator cylinder.

Figure 5:
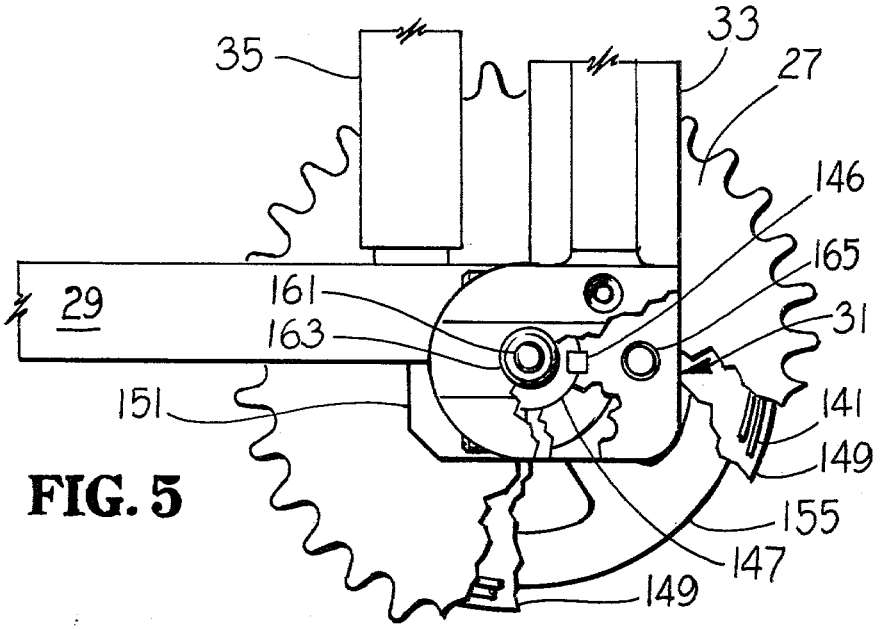
FIG. 5 is an enlarged top plan view partially broken away of a portion of the apparatus of FIG. 1.
Figure 6:
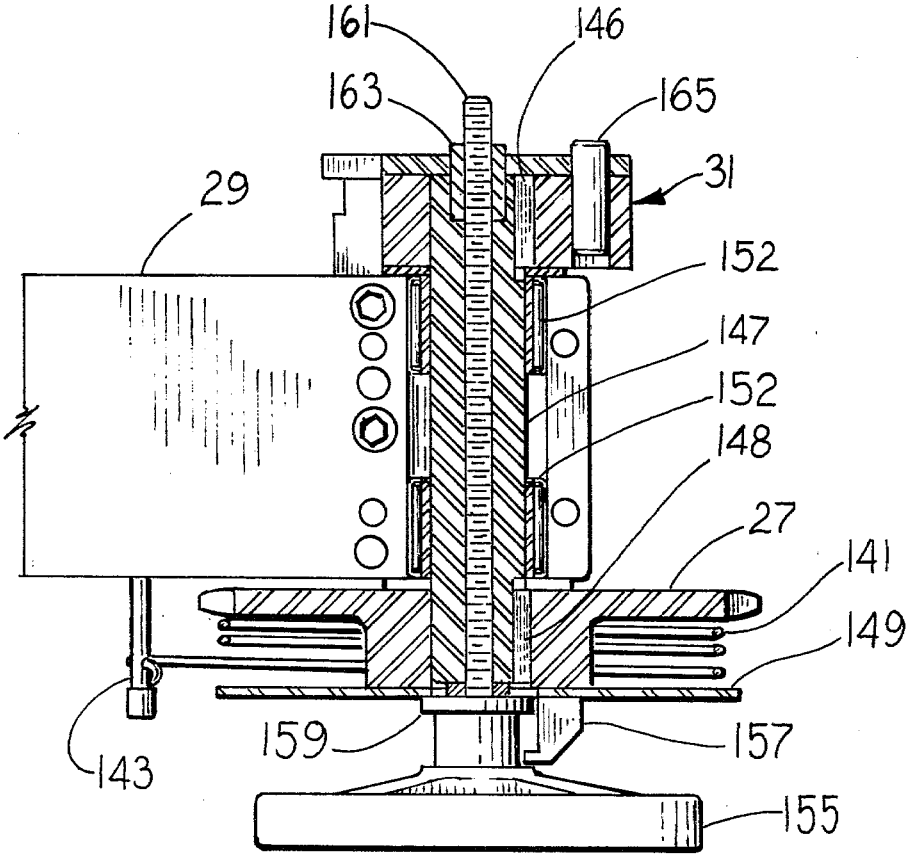
FIG. 6 is an enlarged vertical sectional view partially in section of a portion of the apparatus in FIG. 1.

As best seen in FIGS. 5 and 6, the necessity for two-way application of force from the chain to the sprocket 27 is avoided by providing a torsion spring 141 which encircles the hub of sprocket 27 and is connected at one end thereto. The other end of spring 141 is secured to a pin 143 extending from arm 29. The torque provided by spring 141 is modest as it is only required to overcome friction forces. It is an advantage of the apparatus that the torque of spring 141 may be small so that the acceleration in returning the die table and tube clamp arm is also small and therefore likelihood of injury to the operator in the return stroke of the apparatus is minimized. Spring 141 may conveniently be a coiled leaf spring or a coiled wire spring although the former is preferred.

Figure 7:
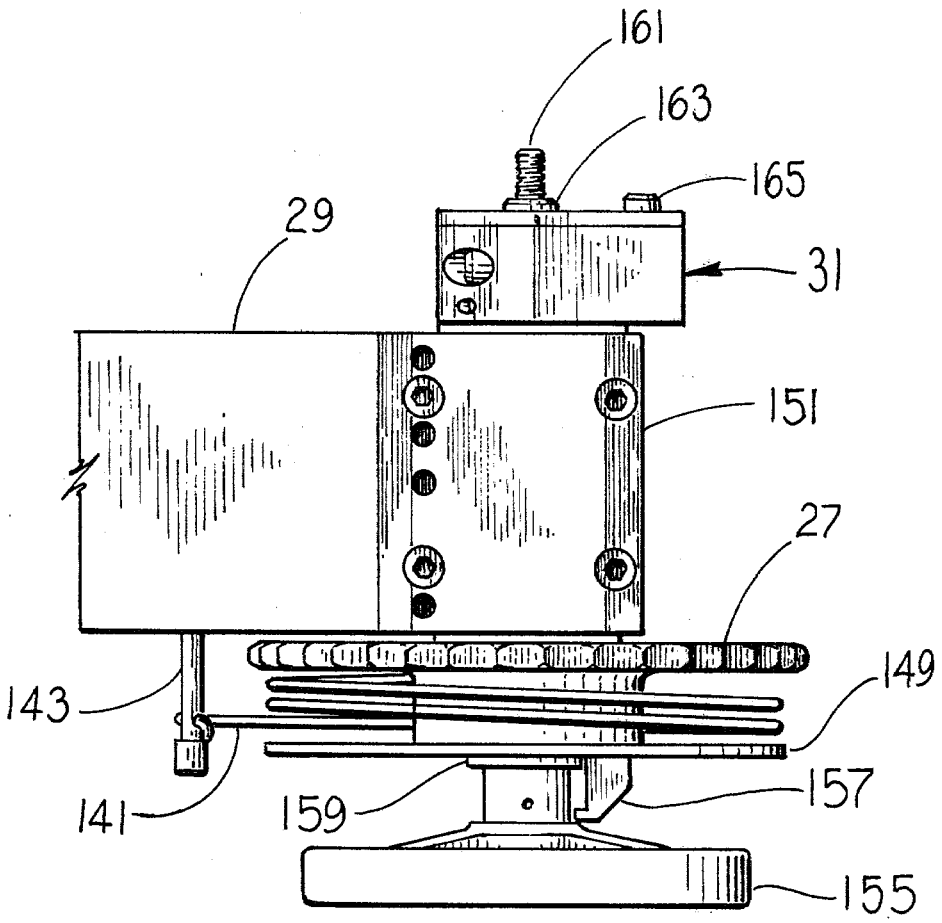
FIG. 7 is an enlarged elevational view of a portion of the apparatus of FIG. 1.

The rotational coupling between sprocket 27 and die mount table 31 is shown in FIGS. 5, 6, and 7. A spring retainer disc 149 is secured to the hub of sprocket 27 to restraint spring 141 and prevent it from becoming kinked or tangled. Disc 149 may be unnecessary if a leaf spring is used in place of the illustrated wire spring 141. A large shaft 147 rotationally couples the sprocket 27 to the die mount table 31, each of which is secured rotationally with respect to shaft 147 by key 148 and 146 or other suitable means. A journal block 151 is utilized in the particular embodiment shown to permit each fabrication of the journal for the shaft 147. A pair of needle bearings or bushings are secured between block 151 and arm 29 in the cylindrical bore therein and provide the bearings for shaft 147.

The shaft 147 has a hollow center, and a long threaded bolt 161 extends through the hollow shaft 147 and is secured at its lower end to hand wheel 155. Hand wheel 155 has a collar 159 which cooperates with a lug finger 157 to prevent hand wheel 155 and bolt 161 from dropping out of the die mount table assembly.

The top of shaft 147 is counter-bored to receive a centering boss 163 which has a center opening for the bolt 161. Centering boss 163 extends above the surface of die mount table 31. Each bending die to be used on the apparatus has a bore to fit boss 163 concentric with the rotational axis of the die and a hole in the boss recess also concentric with that axis which is dimensioned and tapped to receive the threaded end of bolt 161. Each die also has a round hole to receive a driving stud 165 which may comprise a hardened steel pin set into a hole in die mount table 31 by force-fitting or otherwise.

To mount a die on the die mount table 31 it is placed with its boss recess over boss 163 and the drive stud opening over drive stud 165 and the hand wheel 155 is raised and rotated to thread bolt 161 into the threaded opening in the bottom of the die so that the die is pulled down securely to the top surface of the die mount table 31 and constrained to rotate with the die mount table 31 which in turn rotates with sprocket 27.

Figures 8, 9:
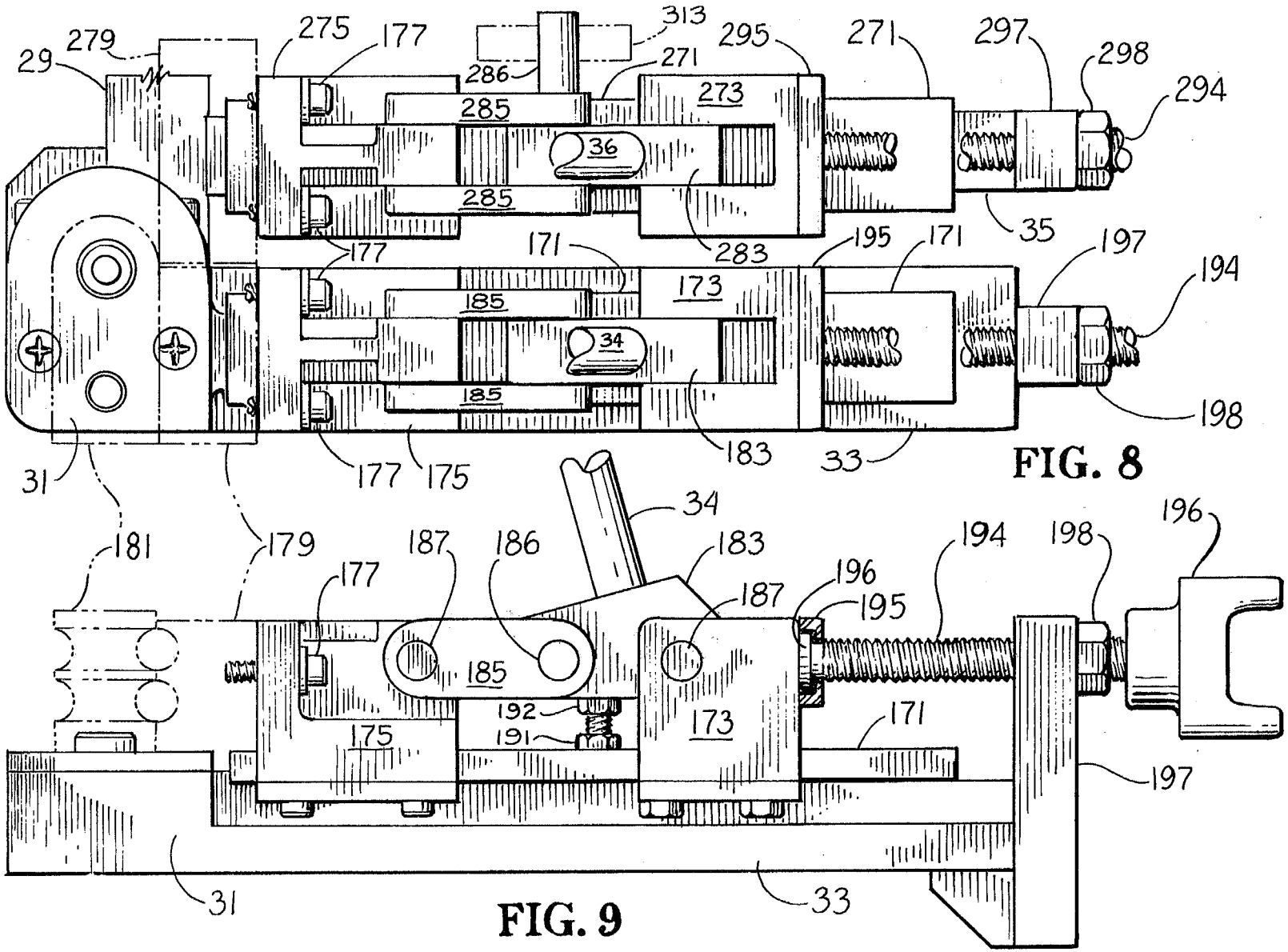
FIG. 8 is an enlarged top plan view partially in section of a portion of the apparatus of FIG. 1.
FIG. 9 is an enlarged fragmentary side elevational view of a portion of the apparatus of FIG. 1.

Details of the tube clamp and the wiper block clamp are best seen in FIGS. 8 and 9. The wiper block clamp is similar to the tube clamp except that the wiper block clamp arm 35 is stationary whereas the tube clamp arm 33 extends from die mount table 31 and rotates with it in the tube bending operation. The tube clamp will be described first and the wiper block clamp will be described later in less detail due to their similarity. On tube clamp arm 33 is a rail 171 on which are two slides, a rear slide 173 and a front slide 175. Slide 175 is provided with holes for bolts 177 which are used to secure a tube jaw 179 to the face of slide 175. Tube jaw 179 will be matched with bend die 181 so that the two acting in cooperation clamp the tubes to be bent firmly therebetween.

Front slide 175 is connected to rear slide 173 with a toggle mechanism including a rear toggle lever 183, a pair of front toggle links 185, and pivot pins 187. A screw 191 with a locking nut 192 acts as a stop for rear toggle lever 183 so that its most counter-clock wise position as shown in FIG. 9 puts the pin connecting rear toggle lever 183 and forward toggle links 185 very slightly below the center line between the pins 187. Handle 34 is welded or otherwise secured to rear toggle lever 183 so that it may be rotated to clamp and lock and to unlock and unclamp the tubes between tube jaw 179 and tube bending die 181.

Motion of slide 173 is restrained by flange 196 on screw 194 bearing against the end of slide 173. Screw 194 is readily rotated by handle 196 to advance screw 194 though a tapped opening (not shown) in back plate 197. Flange 196 is captured against slide 173 by collar 195 which is counterbored to receive flange 196.

Nut 198 acts as a locking nut so that once the rear slide 173 is properly positioned for a particular setup, nut 198 may be tightened against back plate 197 to retain proper positioning of slide 173 and proper operation of the tube clamp.

The wiper block clamp structure is very similar to the tube clamp structure and its clamping operation is substantially identical. Wiper block clamp arm 35 is secured to and extends from arm 29. On it is mounted rail 271 on which are mounted a forward slide 275 and a rear slide 273 connected by toggle lever 283 and toggle links 285 with their pivot pins 286 and 287 (not shown). Rear toggle lever 283 is provided with a handle 36. A wiper block 279, which is designed in a conventional manner to cooperate with die 181, is mounted to the face of block 275 by bolts 277 extending through holes (not shown) in slide 275. A stop is provided for toggle lever 283 consisting of a screw 291 with a locking nut 292 (not shown) similar to screw 191 and nut 192. The rearmost position of slide 273 may be set by positioning screw 294 against the end of slide 273 with handle 296 (not shown). Screw 294 extends through a tapped opening in back plate 297. The adjustable stop may be locked in position by tightening locking nut 298 against back plate 297.

Figure 10:
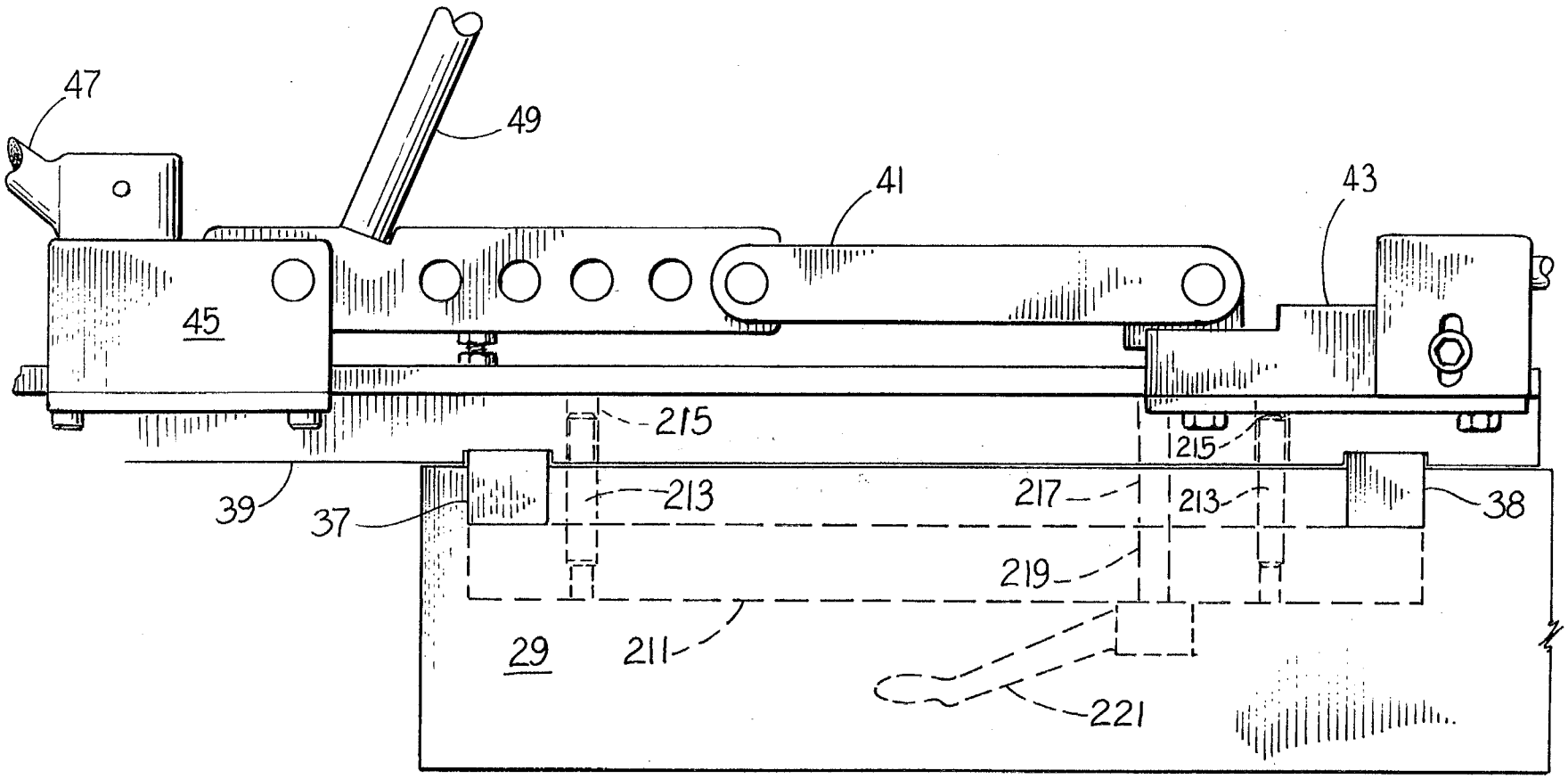
FIG. 10 is an enlarged fragmentary front elevational view of a portion of the apparatus of FIG. 1.
Figure 11:
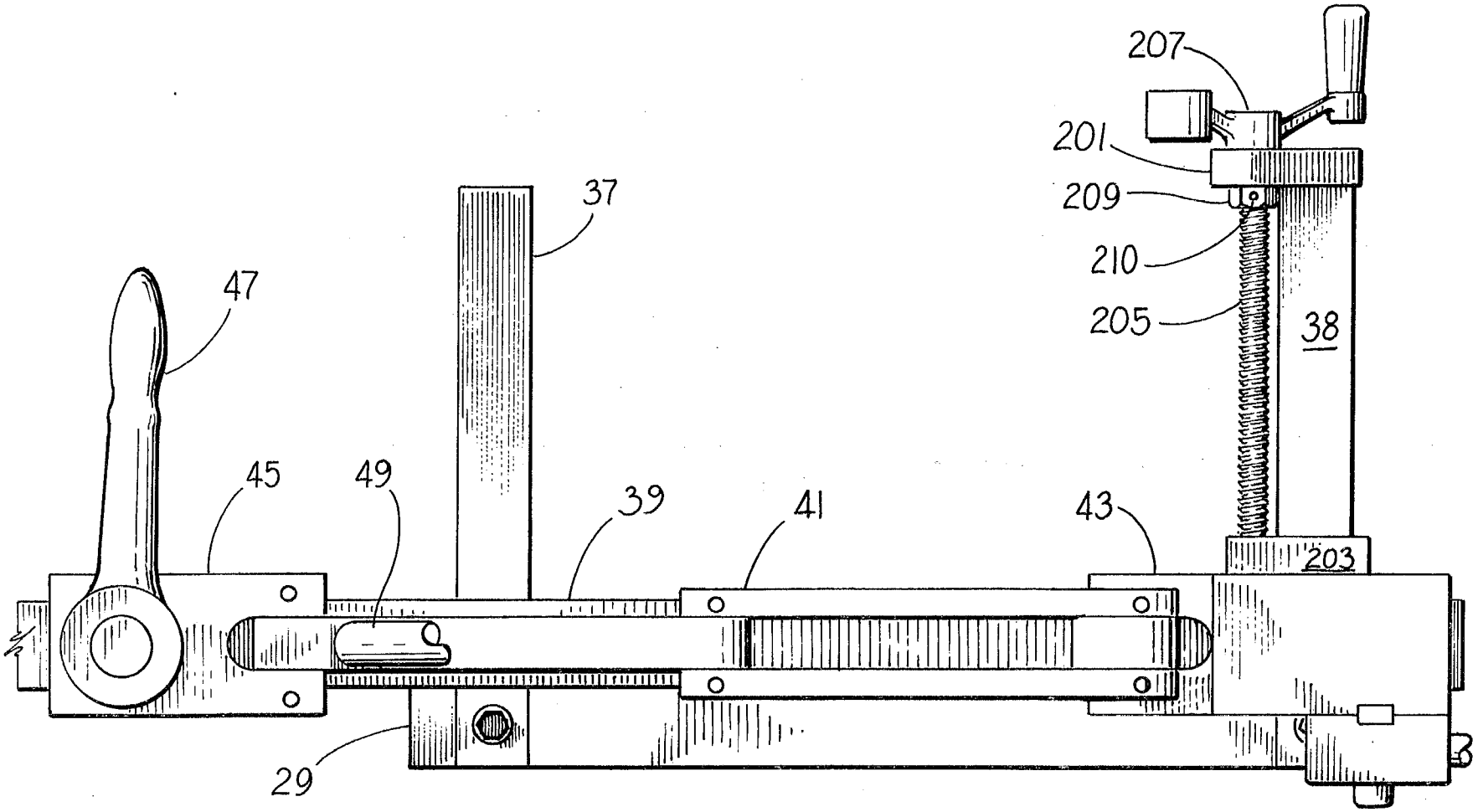
FIG. 11 is an enlarged fragmentary top plan view of a portion of the apparatus of FIG. 1.

As previously mentioned the mandrel adjustment apparatus includes mandrel extractor rail 39 which slides on cross rails 37 and 38 so that the position of mandrel 40 in a horizontal plane is adjustable both longitudinally and transversely. Details of this apparatus are better seen in FIGS. 10 and 11. The transverse or lateral position of the mandrel carriage table 43 is adjusted by a screw transport mechanism which includes a journal block 201 secured at the outer end of cross rail 38, a block 203 secured to extractor rail 39 having an internally threaded opening adapted to engage a threaded rod 205 and a handle 207 affixed to the end of rod 205 so that rod 205 may be rotated to transport block 203 and hence extractor rail 39 back and forth along cross rails 37 and 38. A collar nut 209 on rod 205 is secured by set screw 210 and holds the end of rod 205 in place in journal back 201. In order that extractor rail 29 may be firmly secured in place a locking bar 211 extends between and under cross rails 37 and 38 and is held parallel to extractor rail 39 by pins 213 secured to bar 211 and sliding snugly in openings 215 in extractor rail 39.

A bolt 217 extends from extractor rail 39 and passes through a clearance opening 219 in locking bar 211 and at least partially into a tapped opening in locking handle 221.

Locking handle 221 holds locking bar 211 in engagement with the holes 215 in extractor rail 39 by pins 213. If locking handle 221 is not tightened bar 211 will be out of contact with the bottoms of cross rails 37 and 38 and extractor rail 39 can be readily moved laterally by rotation of handle 207. When the mandrel 40 is properly positioned laterally it may be locked in position by tightening locking handle 221 which squeezes cross rails 37 and 38 between locking bar 211 and extractor rail 39.

Figure 12:
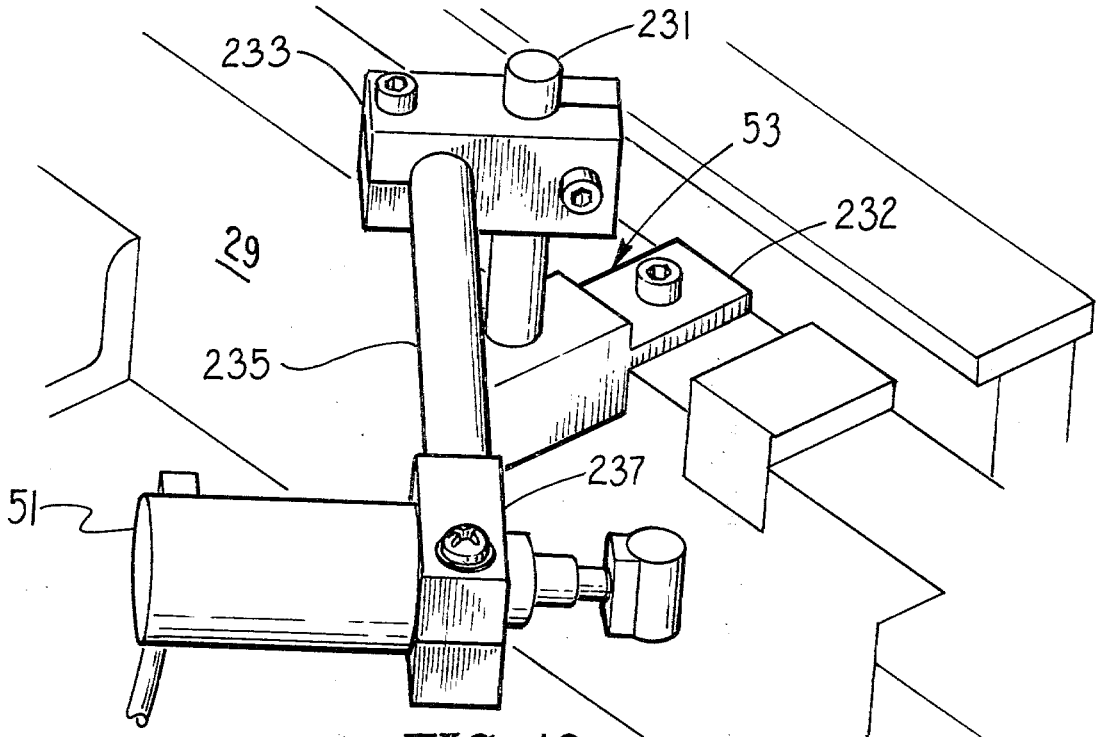
FIG. 12 is an enlarged perspective view of the knock-out cylinder mount also shown in FIG. 2.
Figure 13:
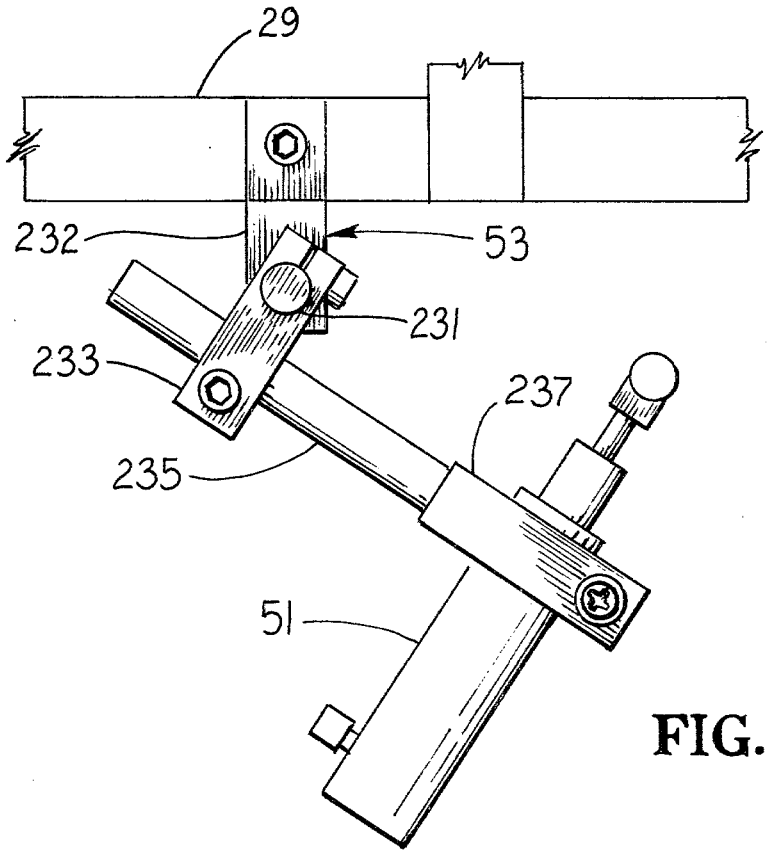
FIG. 13 is an enlarged fragmentary plan view of the apparatus of FIG. 12.

In FIGS. 12 and 13 the adjustable mounting fixture 53 for knockout cylinder 51 is shown. A post 231 is mounted by a bracket 232 on arm 29. A double spit-ring clamp 233 clamps on post 231 so that it is rotatable about post 231 as an axis. An arm 235 is gripped in clamp 233 extending horizontally. Cylinder 51 is retained in clamp 237 on the end of arm 235. The mounting fixture 53 makes the cylinder 51 universally adjustable as clamp 233 is both rotatable about post 231 and also may be raised and lowered on post 231. Arm 235 is rotatable in clamp 233 so that the angle of cylinder 51 is adjustable. Arm 235 may also be extended and retracted in clamp 233 to locate cylinder 51 at a greater or lesser distance from post 231.

Figure 14:
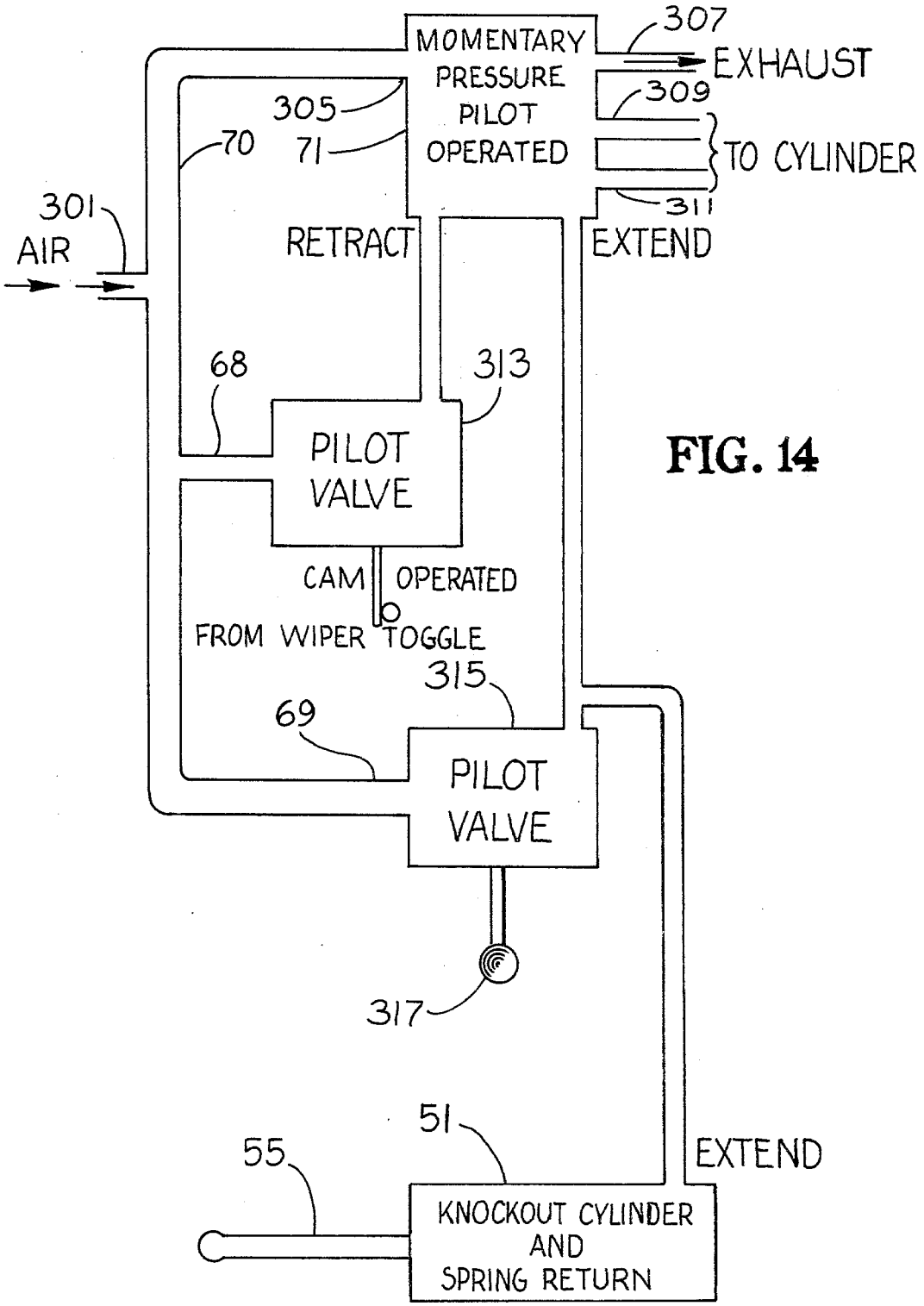
FIG. 14 is a schematic diagram of the cylinders, valves and air conduits by which the powered operation of the apparatus is controlled.

The system for pneumatic power operation of the tube bending apparatus is shown schematically in FIG. 14. Air under pressure enters the pneumatic system at inlet 301. In accordance with conventional techniques the air will normally pass through a filter, a regulator and an oiler before entering the system.

The inlet air is connected to pressure port 305 of main valve 71. Main valve 71 is a 4-way momentary pressure pilot operated valve with four ports 305, 307, 309, and 311.

Port 305 is a pressure port and port 307 is an exhaust port of valve 71 and these two ports are connected by the valve to cylinder ports 309 and 311, respectively, or vice-versa, depending upon the state of valve 71. Pressure on the conduit leading from port 309 extends cylinder shaft 21; pressure on the conduit leading from port 311 to the cylinder retracts cylinder shaft 21.

Main valve 71 is operated by pilot valve 313 to initiate the retract function of cylinder 17 and is operated by pilot valve 315 to initiate the extend function of cylinder 17.

Pilot valve 313 is preferably operated by the motion of toggle lever 285 of the wiper block clamp mechanism which has extending therefrom a pin 286 so that downward motion of pin 286 operates pilot valve 313 situated thereunder and causes cylinder shaft 21 to retract to power the bending operation. Locking of the wiper block clamp by hand movement of handle 36 is the last stage in the operation prior to bending and thus the operator can rapidly carry out the process without the necessity for an additional motion to start the bending operation.

The extend motion of cylinder shaft 21 is initiated by operating pilot valve 315 by hand. It is found convenient to mount pilot valve 315 to mandrel toggle clamp 45 with the operating key 317 of pilot valve 315 extending toward the front of the apparatus as seen in FIG. 3. Obviously the placement of pilot valve 315 and its operating key 317 is not critical and it may be placed for the maximum convenience and/or safety of the operator.

Pilot valve 315 which causes extension of cylinder shaft 21 and return of the apparatus to the initial position also has a conduit leading from its output port to knockout cylinder 51. Accordingly, commencement of the return motion of the die mount table 31 occurs simultaneously with a stroke of the piston of the knockout cylinder 51 which causes the finished part in the die to be knocked loose so that it may fall freely to a container for finished parts. Knockout cylinder 51 has a spring return so that shaft 55 is immediately retracted while the return of the die mount table 31 and the tube clamp arm 33 is being completed. As previously mentioned, the return of die mount table 31 and tube clamp arm 33 is not powered by cylinder shaft 21 but is rather caused by the action of torsion spring 141. The extension of shaft 21 is pneumatically powered in the pneumatic system illustrated in order that spring 141 does not have to provide the force to extend shaft 21. An alternative arrangement could be provided wherein no power was provided to the end of the cylinder for extension of shaft 21 and the force for extension of shaft 21 would be provided by a somewhat stronger torsion spring 141.

As will be obvious to those skilled in the art, pneumatic cylinders could be added to the particular apparatus illustrated to partially or entirely power various apparatus functions which are powered by hand in the illustrated embodiment. By way of example, but not limitation, the following functions, or some of them, might be powered or power-aided by pneumatic cylinders: mandrel injection and retraction, tube clamp locking and wiper block clamp locking. The apparatus could be arranged so that unlocking operations were effected by spring return mechanisms; on the other hand locking operations could be effected by spring loaded mechanisms while unlocking was effected by pneumatic power.

In all cases where pneumatic cylinders are shown, described or suggested, it will be appreciated that hydraulic cylinders might be substituted to advantage in some cases. The basic principals of operation of the apparatus would be the same with hydraulic cylinder operation. Alternatively other forms of linear actuator such as electrically powered screw actuators or the like could be substituted in the apparatus. In the drawings in order that the operating parts be more readily seen, the apparatus is shown with all shields and guards removed. It will be understood that in accordance with conventional practice moving parts such as the sprocket and chain which could cause injury to the operator will be covered by a shield or guard. Also, a guard rail is preferably provided extending in an arc around the center of rotation of the bend die at a distance somewhat greater than the length of the tube clamp arm so that the operator will be restrained from moving into a position where the operator might be struck by the motion of the tube clamp arm.

The setup and operation of the apparatus may proceed as follows. The appropriate bend die, tube clamp jaw, and wiper block will be provided for making the tubing component to be produced. Precut pieces of tubing of the appropriate length, diameter and wall thickness will be provided to the operator. The operator will bolt the tube clamp jaw and the wiper block on the tube clamp and the wiper block clamp, respectively. The bend die is placed on the bend die mount table as previously described and tightened in place by turning hand wheel 155.

It will generally be necessary to adjust the tube clamp and the wiper block clamp in a new setup. This is accomplished by loosening the nut 198 of the tube clamp and using knob 196 to adjust the tube clamp for proper clamping of tubing in the bend die. A similar adjustment of the wiper block clamp is made by loosening nut 298 and adjusting handle 296.

An appropriate mandrel or mandrel set is secured on mandrel carriage 43 and adjusted to a height such that the mandrel enters a tube in the bend die. The lateral position of the carriage 43 is adjusted by rotation of handle 207 and the depth of entry of the mandrel into the tube is adjusted by positioning clamp 45 and locking it with handle 47. Lateral position is locked by tightening handle 221. The position of tubing in the bend die is normally determined by an abutment in the bend die against which the end of the tubing is placed before being clamped in position. If necessary mandrel toggle 41 is adjusted to change the length of stroke of mandrel carriage 43.

The degree of bend is set by loosening knob 131 and turning wheel 119 to place the pointer 137 opposite the desired reading on scale 135. Knob 131 is then tightened to retain that setting.

Knockout cylinder 51 is positioned by loosening the bolts and the bracket as necessary and bumper 57 is placed in proximity to the trailing end of the tubing at the end of a bend stroke so that the tubing is knocked out of the die by the stroke of cylinder 51.

The operation of the apparatus in production has been generally described and proceeds as follows. At the beginning of the operation all toggles are in the opened position with handles 34, 36, and 49 moved away from the bend die. A tubing work piece is inserted by hand into the bend die against the positioning abutment or stop in the bend die and the tube clamp is closed by operation of handle 34. The mandrel or mandrel set is inserted by operation of handle 49, and the wiper block is positioned by the operation of handle 36 which actuates cylinder 17 whose shaft retracts rotating the bend die and tube clamp arm 33 to make the bend to the predetermined angle set by locking unit 121. The handles 49, 34, and 36 are returned to their starting positions preferably in the above stated order. At this point the finished tube workpiece will often be stuck in the bend die. The operator then presses key 317 of pilot valve 315 which causes the knockout cylinder to extend momentarily to knock the finished tubing component out of the bend die.

The same pulse of pressure from the pilot valve 315 shifts main valve 71 to cause extension of shaft 21 of cylinder 17 permitting spring 141 to return the bend die mount table 31 to its original position.

From the foregoing description and explanation it will be appreciated that an improved tube bending machine is provided according to the present invention which is remarkably adapted to quick change of dies and setup for different bending operations and at the same time is capable of good hand fed production rates while having features that aid in the elimination of accidents or injuries and contribute to the safety of operation. While variations and modifications to the preferred embodiment of the apparatus have been described or suggested, numerous other variations and modifications of the apparatus will be apparent to those skilled in the art. The apparatus has a number of distinct features, one or more of which could be omitted while still retaining certain of the advantages of the invention. The invention has been described as applied to tube bending but it will be apparent that essentially the same machine without use of the mandrel apparatus would be suitable for bending wire, rod, or bar stock. In view of these and other possible variations to the apparatus the scope of the invention is not to be considered limited to the specific embodiments and variations thereto which are shown, described, or suggested, but is rather to be determined by reference to the appended claims.

What is claimed is:

1. In a tubing bending machine including a linear actuator having an operating rod, a rotatable die table with a top adapted to support a die, a die with a bottom adapted to rest on said table, a tubing clamp, and a wiper block to bend a tubing workpiece, the improvement comprising, a sprocket secured to rotate with said die table and clamp, at least one projection on said top of said die table mating with a depression in said bottom of said die, a draw bolt with a threaded upper end and a lower end, a hand wheel secured to the lower end of said draw bolt, said draw bolt extending through said sprocket and die table and adapted to threadedly engage a tapped hole in the bottom of said die and secure it to said table, a chain wrapped partially around said sprocket and having one end secured thereto; the other end of said chain being secured to the operating rod of said actuator, and a torsion spring connected to said sprocket to rotate said sprocket in a direction to apply tension to said chain.

2. Apparatus as recited in claim 1 wherein said actuator is fluid pressure operated, said apparatus further including a clamp with an operating lever for clamping a wiper block in position and a valve with a pressure output and operated by the lever of said clamp, said valve pressure output being connected to provide a fluid pressure signal to control said actuator to cause rotation of said bend die.

3. In a tubing bending machine including a linear fluid pressure operated actuator having an operating rod, a rotatable die table with a top adapted to support a die, a die with a bottom adapted to rest on said table, a tubing clamp, and a wiper block to bend a tubing workpiece, the improvement comprising, a sprocket secured to rotate with said die table and clamp, a chain wrapped partially around said sprocket and having one end secured thereto; the other end of said chain being secured to the operating rod of said actuator, a clamp with an operating lever for clamping a wiper block in position, a valve with a pressure output and operated by the lever of said clamp, said valve pressure output being connected to provide a fluid pressure signal to control said actuator to cause rotation of said bend die, and a torsion spring connected to said sprocket to rotate said sprocket in a direction to apply tension to said chain.

4. Apparatus as recited in claim 3 further including a second valve having its pressure output connected to provide a fluid pressure signal to control said actuator to cause return rotation of said bend die by said spring.

5. Apparatus as recited in claim 4 further including, a workpiece ejection actuator having an armature, a universally adjustable clamp for positioning the said ejection actuator so that its armature will strike a workpiece to dislodge it from said die, and means for coupling said second valve to said workpiece ejection actuator.

6. Apparatus as recited in claim 5, wherein said operating rod is provided with an abutment and further including an adjustable stop in the path of said abutment, a pointer which moves with said stop, and a scale calibrated in degrees against which the position of said stop is indicated by said pointer.

7. In a tubing bending machine including a linear actuator having an operating rod, a rotatable die table with a top adapted to support a die, a die with a bottom adapted to rest on said table, a tubing clamp, and a wiper block to bend a tubing workpiece the improvement comprising, a sprocket secured to rotate with said die table and clamp, a chain wrapped partially around said sprocket and having one end secured thereto; the other end of said chain being secured to the operating rod of said actuator, a pilot valve with a pressure output connected to provide a fluid pressure signal to control said actuator to cause return rotation of said bend die by said spring, a workpiece ejection actuator having an armature, a universally adjustable clamp for positioning the said ejection actuator so that its armature will strike a workpiece to dislodge it from said die, means for coupling said pilot valve to said workpiece ejection actuator, and a torsion spring connected to said sprocket to rotate said sprocket in a direction to apply tension to said chain.

8. Apparatus as recited in claim 7 wherein said actuator is fluid pressure operated and further including, a clamp with an operating lever for clamping a wiper block in position, and a valve with a pressure output and operated by the lever of said clamp, said valve pressure output being connected to provide a fluid pressure signal to control said actuator to cause rotation of said bend die.

9. In a tube bending machine including a linear actuator having an operating rod with an abutment, a rotatable die table with a top adapted to support a die, a die with a bottom adapted to rest on said table, a tubing clamp, and a wiper block to bend a tubing workpiece, the improvement comprising, a generally circular member secured to rotate with said die table and clamp, a flexible inextensible element wrapped partially around said circular member and having one end secured thereto; the other end of said element being secured to the operating rod of said actuator, a spring connected to said circular member to rotate it in a direction to apply tension to said element, an adjustable stop in the path of said operating rod abutment, a pointer which moves with said stop, a scale against which the position of said stop is indicated by said pointer, at least one projection on said top of said die table mating with a depression in said bottom of said die, a draw bolt with a threaded upper end and a lower end, and a hand wheel secured to the lower end of said draw bolt, said draw bolt extending upwardly through said member and said die table and adapted to threadedly engage a tapped hole in the bottom of said die and secure it to said table.

10. Apparatus as recited in claim 9 wherein said actuator is fluid pressure operated and further including a clamp with an operating lever for clamping a wiper block in position, and a valve with a pressure output and operated by the lever of said clamp, said valve pressure output being connected to provide a fluid pressure signal to control said actuator to cause rotation of said bend die.

* * * * *